US007714078B2

(12) United States Patent
Paraskos et al.

(10) Patent No.: US 7,714,078 B2
(45) Date of Patent: May 11, 2010

(54) ONE POT PROCEDURE FOR POLY (GLYCIDYL NITRATE) END MODIFICATION

(75) Inventors: Alexander J. Paraskos, Ogden, UT (US); Michael A. Dewey, Ogden, UT (US); Wayne Edwards, Tremonton, UT (US)

(73) Assignee: Alliant Techsystems Inc., Edina, MN (US)

( * ) Notice: Subject to any disclaimer, the term of this patent is extended or adjusted under 35 U.S.C. 154(b) by 603 days.

(21) Appl. No.: 11/553,752

(22) Filed: Oct. 27, 2006

(65) Prior Publication Data

US 2008/0188630 A1 Aug. 7, 2008

(51) Int. Cl.
*C08L 63/00* (2006.01)

(52) U.S. Cl. ..... 525/423

(58) Field of Classification Search ..... 525/453
See application file for complete search history.

(56) References Cited

U.S. PATENT DOCUMENTS

| | | | |
|---|---|---|---|
| 5,120,827 | A | 6/1992 | Willer et al. |
| 5,162,494 | A | 11/1992 | Willer et al. |
| 5,587,553 | A | 12/1996 | Braithwaite et al. |
| 5,690,868 | A | 11/1997 | Strauss et al. |
| 6,362,311 | B1 | 3/2002 | Highsmith et al. |
| 6,730,181 | B1 | 5/2004 | Sanderson et al. |
| 6,815,522 | B1 | 11/2004 | Sanderson et al. |
| 6,861,501 | B1 | 3/2005 | Sanderson et al. |
| 2005/0133128 | A1 | 6/2005 | Sanderson et al. |

OTHER PUBLICATIONS

Leeming et al., 27th Int. Ann. Conf. of ICT, Karlsruhe, Germany, 1996.*

Bunyan, P.F., et al., "Stability Studies on End-Modified PolyGLYN," Defence Evaluation and Research Agency, Fort Halstead, Sevenoaks, Kent, TN147BP, UK, ICI Explosives, Stevenston, Ayrshire, KA20 3LN, UK, 6 pages, British Crown Copyright 1997/DERA.

Paul, Norman, "Modification of the End Nitrato Groups in PolyGLYN to Epoxides," and "Ring Opening of Epoxide End Groups of Modified PolyGLYN by Hidrolysis," Synthetic Chemistry, DRA, Fort Halstead, Jul. 1996, 5 pages.

Paul, N.C., et al., "An Improved polyGLYN Binder Through End Group Modification," Proceedings of the International Symposium on Energetic Materials Technology, Sep. 24-27, 1995, Phoenix, Arizona, pp. 52-60.

* cited by examiner

*Primary Examiner*—Randy Gulakowski
*Assistant Examiner*—Shane Fang
(74) *Attorney, Agent, or Firm*—TraskBritt

(57) ABSTRACT

A method is provided in which PGN is end-modified in a process using a single solvent. The resulting end-modified PGN may be stably crosslinked using aliphatic polyisocyanates. Further provided are methods of producing energetic compositions comprising PGN which has been end-modified in a process using a single solvent. Such energetic compositions may be stably crosslinked using aliphatic polyisocyanates.

20 Claims, 7 Drawing Sheets

ONE POT PROCEDURE FOR POLY (GLYCIDYL NITRATE) END MODIFICATION

BACKGROUND OF THE INVENTION

1. Field of the Invention

This invention relates to a method for modifying poly (glycidyl nitrate) that allows the poly(glycidyl nitrate) to be stably cured through the use of aliphatic polyisocyanates. This invention further relates to the production of solid energetic compositions, such as propellants, explosives, pyrotechnics, and gas generants, comprising poly(glycidyl nitrate) binders.

2. State of the Art

Solid high energy compositions, such as propellants, explosives, pyrotechnics, and gasifiers, and the like, generally comprise solid particulates, such as fuel particles, oxidizer particles, or a combination of both, dispersed and immobilized in a cured binder matrix.

In recent years, energetic polymers have been developed and evaluated as potential replacements for inert polymeric binders in cast propellant systems, explosive compositions, and pyrotechnics. The substitution of an energetic polymer for an inert polymer in a conventional pressable or extrudable explosive composition generally increased the detonation pressure and detonation velocity of the explosive.

Poly(glycidyl nitrate) (also known as "PGN" and "polyGLYN") has been known and recognized for years as a possible energetic polymer suitable for use in propellants, explosives, pyrotechnics, gas generants, and the like. PGN binders are commonly synthesized by preparing a difunctional glycidyl nitrate polymer and curing the PGN with a polyfunctional isocyanate having a functionality of greater than about 2.3 to give urethane cross-linked polymers. Aromatic and aliphatic polyisocyanates have been selected as the curing agents.

Although glycidyl nitrate prepolymers have a satisfactory shelf life, it is known that aliphatic polyisocyanate cured PGN inherently de-cures when stored at room temperature for prolonged periods. If precautions are not taken, over time, current PGN can de-cure to the point of reverting to a pourable liquid. Accordingly, special care must be taken in the handling and storing of energetic compositions containing PGN cross-linked using aliphatic polyisocyanates. The special care required to avoid a de-curing problem has impeded the widespread use of PGN as a binders despite its attractive energetic properties.

One solution to this de-curing problem is the replacement of the terminal nitrate ester groups of PGN with hydroxyl groups. This solution was first put forth by N. C. Paul et al. *An Improved polyGLYN Binder Through End Group Modification*, ICI Explosives (1998). The article indicates the de-curing problem as being caused by the proximity of the terminal hydroxyl groups of the polymer to nitrate ester groups. The authors conclude that the de-curing problem is an inevitable consequence of the end group structure. To overcome this problem, the article describes a two-step process (illustrated below) that modifies the end groups by removing the adjacent nitrate esters and replacing the nitrate ester groups with hydroxyl groups by base catalyzed hydrolysis. In particular, the first step of the ICI process involves an epoxidation of the terminal hydroxyl group and the adjacent nitrate ester in the presence of KOH and EtOH, with dichloromethane acting as the solvent. The material is then isolated between the steps with removal of the solvent. The material is then redissolved in tetrahydrofuran (THF) in the presence of sulfuric acid and heated so as to open the epoxide ring thus providing a terminal hydroxide group in place of the original nitrate ester. Aging tests have shown that this technique is successful in preventing de-cure of the polymer.

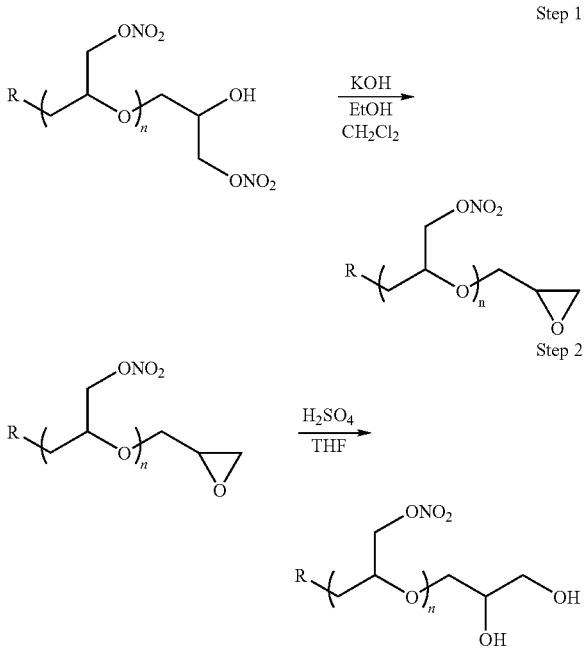

However, the ICI process as described by Paul et al. has drawbacks in that it has two discreet process steps, causing additional expense and chemical waste in production. Accordingly, it would be an improvement in the art to generate the final product of the above-described ICI reaction using fewer chemical process steps and fewer solvents.

BRIEF SUMMARY OF THE INVENTION

In one embodiment, the present invention provides a method of end-modifying PGN in a single solvent to create the following chemical structure:

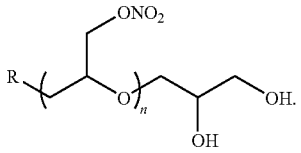

In a further embodiment, the present invention provides a method for the production of an energetic composition comprising; creating, in a single solvent, an end-modified PGN having the following chemical structure:

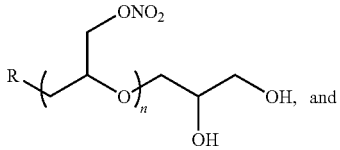

preparing an energetic formulation comprising the end-modified PGN.

BRIEF DESCRIPTION OF THE DRAWINGS

In order to illustrate the manner in which the above-recited and other advantages of the invention are obtained, a more particular description of the invention briefly described above will be rendered by reference to specific embodiments thereof which are illustrated in the appended drawings. As these drawings depict only embodiments of the invention and are not limiting of its scope, the invention will be described and explained with additional specificity and detail through the use of the accompanying drawings in which.

DETAILED DESCRIPTION OF THE INVENTION

Figure 1:
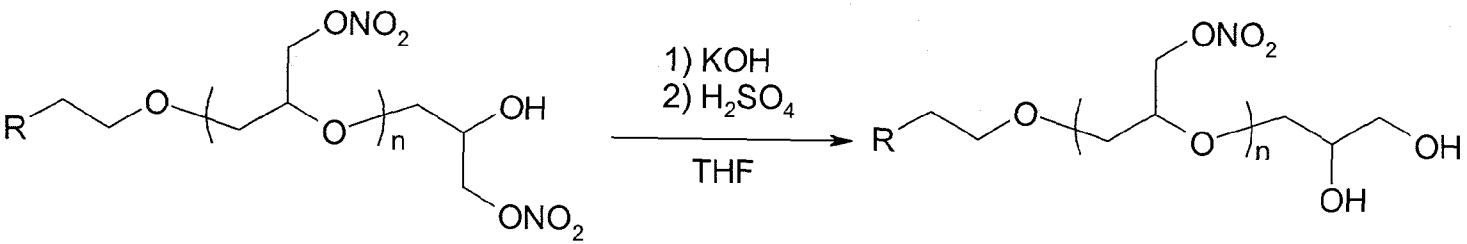
FIG. 1 depicts a chemical structure representation of a chemical process according to an embodiment of the present invention.

Reference will now be made in detail to embodiments of the invention as described below. It should be noted, however, that the invention in its broader aspects is not limited to the specific details, representative structures and methods, and examples described in this section in connection with the described embodiments. The invention according to its various aspects is particularly pointed out and distinctly claimed in the appended claims, and equivalents thereof, read in view of this specification.

In accordance with one embodiment of the invention, a process is provided for the production of end-modified PGN. This process comprises end-modification of PGN through the use of a single solvent such that the terminal nitrate ester is replaced with a hydroxyl group. In one embodiment, the solvent is THF.

In an embodiment of the invention, a first reaction step of epoxidation is carried out. The epoxidation reaction preferably end-modifies the PGN according to the following chemical reaction:

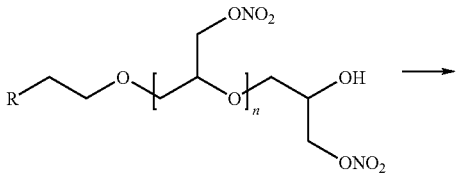

-continued

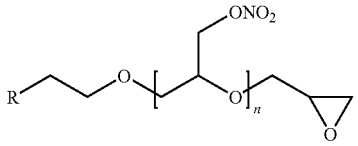

In one embodiment, the epoxidation reaction is carried out using a base. Examples of bases include, but are not limited to, potassium hydroxide (KOH), sodium hydroxide NaOH), potassium t-butoxide, lithium diisopropyl amide, and potassium 2-methyl-2-butoxide. In another embodiment, the reaction is carried out in a jacketed reaction vessel adapted to help maintain the temperature of the chemical reaction. The epoxidation reaction may be carried out at a temperature from about 50° F. to about 100° F., although it is currently more preferred that the epoxidation reaction be carried out a temperature from about 65° to about 85° F., and it is currently most preferred that the epoxidation reaction be carried out at a temperature at about 75° F.

In one embodiment of the present invention, the epoxidation reaction is monitored via $^{13}C$ NMR. For example, to monitor the reaction, a small aliquot of the reaction constituents is obtained and the solvent removed using a rotary evaporator (rotovap), which may be described as essentially an apparatus that rotates the sample in a container while subjected it to decreased atmospheric pressure and increased temperature. The NMR sample may be prepared using standard techniques known in the art, for example, preparing the sample in deuterated dichloromethane, and performing $^{13}C$ NMR. If the NMR reveals that the reaction is complete to a desired extent, the reaction may be stopped. If the reaction is not yet complete to a desired extent, additional base, such as, but not limited to, KOH, may be added to the reaction vessel and the reaction continued. It is currently preferred that the reaction constituents are stirred in the reaction vessel while the epoxidation reaction is ongoing. The epoxidation reaction may be carried out for a time period from about 2 hours to about 12 hours; it is currently more preferred that the epoxidation reaction be carried out for a time period from about 4 hours to about 6 hours; and it is currently most preferred that the epoxidation reaction be carried out for a time period of about 5 hours. As will be apparent to one of ordinary skill in the art, the amount of time allowed for the reaction to take place and the amount of base added to the reaction vessel may be adjusted depending on the proportion of expoxidation desired.

In an additional embodiment, the reaction product of the epoxidation reaction is washed after the epoxide ring-forming reaction step. It is currently preferred that the reaction product be washed at least twice. It is further currently preferred that the reaction product is washed with a saturated sodium chloride solution but, as will be appreciated by one of ordinary skill in the art, a less than saturated solution may be used. In place of a sodium chloride solution, a solution of about 1% $H_2SO_4$ to about 5% $H_2SO_4$ may also be used. It is currently preferred that the reaction product be mildly agitated or stirred during the washing step to avoid the formation of an emulsion. Each washing step may be carried out for a time period from about 1 minute to about 30 minutes; it is currently more preferred that the washing step be carried out for a time period from about 10 minutes to about 20 minutes; and it is currently most preferred that the washing step be carried out for a time period of about 15 minutes. After washing it is currently preferred that any stirring or agitation is stopped and the layers allowed to separate. After separation, it is preferable that the aqueous layer not containing the reaction product of the epoxide ring-forming reaction be removed.

In an embodiment, the completeness of a washing step may be monitored by examining an aliquot of the washed reaction product after separation. It is currently preferred that the washed reaction product be examined for the presence of nitrate. The presence of nitrate can be determined by those techniques currently available to one of ordinary skill in the art, although it is currently preferred that the nitrate level be examined by ion chromatography. It is further currently preferred that any residual nitrate level in the reaction product be less than 1%; more preferable less than 0.5%, and most preferably less than 0.01%. If the nitrate level in the reaction product is greater than desired, additional washing steps may be undertaken.

In a further embodiment, the washed reaction product of the epoxidation reaction is dried of water. As will be appreciated by one of ordinary skill in the art, there are many methods in which a solution may be dried of water, including, but not limited to, chemical drying or heating. It is currently preferred that the drying occurs after washing but before proceeding to a reaction step where the epoxide ring is opened. It is further currently preferred that the drying be carried out using a chemical method, such as by the addition of $MgSO_4$ and/or $Na_2SO_4$. Drying may take place in a period ranging from about 5 minutes to about 24 hours; it is currently more preferred for drying to take place in a period ranging from about 10 minutes to about 23 hours; and it is currently most preferred for drying to proceed for about 30 minutes. If chemical drying is used, it is currently preferred to remove the chemical drying agent using a filter after drying has occurred.

In an embodiment of the invention, a second reaction step of epoxide ring-opening may be carried out. The epoxide ring-opening reaction preferably end-modifies the PGN according to the following chemical reaction:

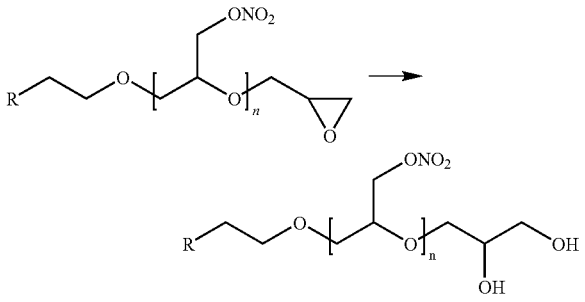

In one embodiment, the epoxide ring-opening reaction is carried out using an acid. Examples of suitable acids include, but are not limited to, sulfuric acid, para-toluene sulfonic acid, acetic acid, and trifluoroacetic acid. In one embodiment, 6 ml of concentrated $H_2SO_4$ is diluted in 800 ml of distilled water and quickly added to the reaction product of the epoxide ring-forming reaction while stirring at room temperature.

In an embodiment, the first reaction step, the second reaction step, and the reaction product of the epoxide ring-forming reaction are carried out in the same reactor. It is currently preferred that the reactor be washed between the reaction steps with water and then with to remove any remaining solids in the reactor.

In one embodiment, the epoxide ring-opening reaction is carried out in a jacketed reaction vessel that is adapted to help maintain the temperature of the chemical reaction. It is currently preferred that the acid be added to the reaction product of the epoxide ring-forming reaction at room temperature. It is further currently preferred that the acid be added to the reaction product of the epoxide ring-forming reaction in a relatively fast manner. It is currently preferred that the acid be added to the reaction product of the epoxide ring-forming reaction over a time period from about 0 minutes to about 30 minutes; it is currently more preferred that the acid be added to the reaction product of the epoxide ring-forming reaction over a time period from about 1 minute to about 15 minutes; it is currently most preferred that the acid be added to the reaction product of the epoxide ring-forming reaction over a time period from about 2 minutes to about 3 minutes.

It is further currently preferred that the combination of the reaction product from the epoxide ring-forming reaction step and the acid be heated to perform the epoxide ring-opening reaction. The epoxide ring-opening reaction may be carried out at a temperature from about 50° F. to about 200° F., it is currently more preferred that the epoxidation reaction be carried out a temperature from about 100° F. to about 150° F., and it most preferred that the epoxidation reaction be carried out at a temperature at about 125° F.

In one embodiment of the present invention, the epoxide ring-opening reaction is monitored via $^1H$ NMR. For example, to monitor the reaction, a small aliquot of the reaction constituents may be obtained and the solvent removed using a rotovap. An NMR sample may then be prepared using standard techniques known in the art, for example, preparing the sample in deuterated acetone, and performing $^1H$ NMR using standard equipment and standard techniques known in the art. If the NMR reveals that the reaction is complete (i.e. absence of epoxides), the reaction may be stopped. If the reaction is not yet complete to a desired extent, additional acid, such as, but not limited to, $H_2SO_4$, may be added and the reaction continued. It is currently preferred that the reaction constituents are stirred in the reaction vessel while the epoxide ring-opening reaction is ongoing. The epoxide ring-opening reaction may be carried out for a time period from about 2 hours to about 12 hours; it is currently more preferred that the epoxide ring-opening reaction be carried out for a time period from about 4 hours to about 6 hours; and it is currently most preferred that the epoxide ring-opening reaction be carried out for a time period of 5 hours. As will be apparent to one of ordinary skill in the art, the amount of time allowed for the reaction to take place and the amount of acid added to the reaction vessel may be adjusted depending on the proportion of epoxide ring-opening desired.

In example embodiment, the reaction product of the epoxide ring-opening reaction is cooled to room temperature. It is currently preferred that during or after cooling, that stirring or agitation is stopped and the reaction mixture allowed to separate. It is currently preferred that after the reaction mixture separates that the water layer (acidic water layer) be removed from the reactor In a further embodiment, after the completion of the epoxide ring-opening reaction, a base is added to the reactor to neutralize at least part of any remaining acid. Examples of suitable bases include, but are not limited to, potassium carbonate ($K_2CO_3$), sodium bicarbonate, sodium carbonate, and potassium bicarbonate. It is currently preferred that the base is $K_2CO_3$. It is further currently preferred that the $K_2CO_3$ is added to the reactor in a 50% solution. It is currently preferred that the $K_2CO_3$ is stirred or agitated with the reaction product of the epoxide ring-opening reaction. The $K_2CO_3$ may be present in the reaction mixture for about 1 minute to 30 minutes; it is currently more preferred that the $K_2CO_3$ is present in the reaction mixture for about 10 minutes to 25 minutes: it is currently most preferred that the $K_2CO_3$ is present in the reaction mixture for about 15 minutes. After the $K_2CO_3$ has been present in the reaction mixture for a desired period of time, it is currently preferred to stop the stirring or agitation and allow the resulting mixture to separate. Once the mixture is separated, it is currently preferred that the water layer (bottom layer) is removed.

In an embodiment, after treatment of the reaction production of the epoxide ring-opening reaction with a base, it is currently preferred that the pH be about 7. The pH can be measured using any technique available to those of ordinary skill in the art, but it is currently preferable to use pH indicator strips.

In a further embodiment, if the pH of the reaction product of the ring-opening reaction is above about 7, the pH can be adjusted using any method available to those of ordinary skill in the art. It is currently preferred to adjust the pH through repeated washing with a brine solution. It is also currently preferred that the resulting brine solution is stirred or agitated. The brine washing may be carried out for a time period from about 1 minute to about 30 minutes; it is currently more preferred that the washing step be carried out for a time period from about 10 minutes to about 20 minutes; and it is currently most preferred that the washing step be carried out for a time period of 15 minutes. After washing, it is currently preferred that any stirring or agitation be stopped and the layers allowed to separate. After separation, the aqueous layer may be removed.

In another embodiment, the pH of the base treated solution or the reaction product of the epoxide ring-opening reaction is monitored before or during the brine washing. The pH may be measured using any technique available to those of ordinary skill in the art, hut it is currently preferable to use pH indicator strips. If the pH is greater than about 7, brine washing may be repeated as necessary until the resulting solution has a pH less than about 7.

In a further embodiment, the washed reaction product of the epoxide ring-opening reaction may be dried of water. As will be appreciated by one of skill in the art, there are many methods in which a solution may be dried of water, including, but not limited to, chemical drying or heating. It is currently preferred that the drying occurs after washing but before proceeding to a reaction step where the epoxide ring is opened. It is further currently preferred that the drying be carried out using a chemical method, such as by the addition of $MgSO_4$ and/or $Na_2SO_4$. Drying may take place from about 5 minutes to about 24 hours; it is currently more preferred for drying to take place from about 10 minutes to about 23 hours; and it is currently most preferred for drying to proceed for about 30 minutes. If chemical drying is used, it is currently preferred to remove the chemical drying agent using a filter after drying has occurred.

In another embodiment, the solvent is removed from the reaction product of the epoxide ring-opening reaction. It is currently preferred that the solvent be removed after the pH has been adjusted to about 7. The solvent may be removed by any method available to those of ordinary skill in the art, such as, but not limited to, sparging with gas or through the use of a rotovap. It is currently preferred to use a rotovap to remove the solvent. It is further currently preferred that the heat within the rotovap be less than about 122° F.

In a further embodiment, once the solvent is removed, the resulting end-modified PGN may be redissolved in dichloromethane. An equal volume of water may then be added and the resulting mixture returned to the reaction vessel. It is currently preferred that this mixture be stirred or agitated. It is also currently preferred that any stirring or agitation performed in accordance with this embodiment is mild in nature so that an emulsion does not form. The mixture may be stirred or agitated for a time period from about 1 minute to about 30 minutes; it is currently more preferred to stir or agitate the mixture for a time period from about 5 minutes to about 15 minutes; and it is currently most preferred to stir or agitate the mixture for a time period of 10 minutes. After stirring, it is currently preferred that any stirring or agitation is stopped and the layers allowed to separate. After separation, the aqueous layer may be removed.

In another embodiment, the end-modified PGN dissolved in dichloromethane may be dried of water. As will be appreciated by one of ordinary skill in the art, there are many methods in which a solution may be dried of water, including, but not limited to, chemical drying or heating. It is currently preferred that the drying occurs after washing but before proceeding to a reaction step where the epoxide ring is opened. It is further currently preferred that the drying be carried out using a chemical method, such as by the addition of $MgSO_4$ and/or $Na_2SO_4$. Drying may take place from about 5 minutes to about 24 hours; it is currently more preferred for drying to take place from about 10 minutes to about 23 hours; and it is currently most preferred for drying to proceed for about 30 minutes. If chemical drying is used, it is currently preferred to remove the chemical drying agent using a filter after drying has occurred.

In an embodiment, after drying the PGN dissolved in dichloromethane of water, the dichloromethane may be removed. The dichloromethane may be removed by any method available to those of ordinary skill in the art, such as, but not limited to, sparging with gas or through the use of a rotovap. It is currently preferred to use a rotovap to remove the dichloromethane. It is further currently preferred that the heat within the rotovap be less than about 122° F.

In a further embodiment, when at least most of the dichloromethane has been removed from the end-modified PGN dissolved in dichloromethane, $CHCl_3$ may be added. Once the $CHCl_3$ has been added, all solvents may then be substantially removed using a rotovap as described above.

A further embodiment of the invention relates to methods of manufacturing PGN polymers with the end-modified PGN created in accordance with the above-described procedures. The creation of PGN polymers is well known in the art and any procedure recognized as suitable may be used. The PGN may be polymerized before end-modification using any catalyst that causes PGN polymerization, such as, but not limited to, protic acids and Lewis acids including $BF_3 \cdot THF$, $BF_3$, $HBF_4$, $PF_5$, boron trifluoride diethyl etherate as well as triethyloxonium hexafluorophosphate, triethyloxonium hexafluoroantimonate, and triethyoxonium tetrafluoroborate. Further, a polyol initiator may be used separately or in conjunction with the catalyst as described, for example, in U.S. Patent Application Publication 2005/0133128.

A further embodiment of the invention relates to methods of cross-linking PGN polymers manufactured with end-modified PGN created in accordance with the above-described procedures. Cross-linking of PGN polymers is well known in the art, and any substance or procedure suitable for such cross-linking may be employed. Examples of substances which may be used to cross-link the PGN polymers include, but are not limited to, aromatic polyisocyanates, aliphatic polyisocyanates, dibutyltin dilaurate, dibutyltin dichloride, and dibutyl-di tin-dilaurate. An additional embodiment of the invention relates to methods of cross-linking PGN polymers containing end-modified PGN created in accordance with the above-described procedures. Another embodiment of the invention relates to cross-linked PGN polymers created with end-modified PGN created in accordance with the above-described procedures.

In further accordance with these embodiments of the invention, the process includes cross-linking the end-modified PGN with at least one aliphatic polyisocyanate. Examples of aliphatic polyisocyanates for use in accordance with embodiments of the present invention include, but are not limited to, hexamethylene diisocyanate, hydrogenated diphenylmethane diisocyanate, isophorone diisocyanate, hydrogenated tolylene diisocyanate, DESMODUR® N-100, DESMODUR® N-3200, and the like.

The end-modified PGN as obtained through described versions of the inventive process and their equivalents can be utilized in explosive compositions without the need for further purification or recrystallization steps.

End-modified PGN may be used in combination with conventional or novel propellant and solid explosive ingredients as the basis for formulating very high performance insensitive propellant and explosive compositions. Propellant and explosive compositions suitable for use with end-modified PGN are disclosed in, for example, U.S. Pat. No. 5,587,553 and U.S. Pat. No. 5,690,868. Techniques for combining end-modified PGN into energetic formulations and curing the formulations are well known in the art. Generally, the end-modified PGN is mixed with the other ingredients of the explosive composition, including the curative, followed by addition of the cure catalyst. Of course, other sequences for combining ingredients fall within the scope of this invention and are readily apparent to those of ordinary skill in the art.

Representative explosive or energetic materials that can be made with end-modified PGN include gun propellants, cast cure explosives, and extrudable explosives. The explosive (or energetic) materials in accordance with embodiments of the present invention are, preferably, not in the form of a foam.

Generally, a gun propellant may comprise about 15 weight percent to about 40 weight percent of binder and plasticizer (at a plasticizer-to-binder weight ratio of, for example, 0:1 to 3:1), 0 to about 80 weight percent filler, such as nitramine (e.g., RDX, HMX and/or CL-20), and optionally about 0.5 weight percent to about 5 weight percent ballistic modifiers.

Cast cure explosives in which end-modified PGN may be used generally comprise as ingredients about 5 weight percent to about 20 weight percent end-modified PGN binder and, optionally, other binders, about 0.5 weight percent to about 3 weight percent curative, about 0.25 weight percent to about 2 weight percent cure catalyst, and about 20 weight percent to about 80 weight percent oxidizer. Suitable and nonlimiting examples of oxidizers include ammonium perchlorate and/or ammonium nitrate.

Conventionally, formulations for extrudable explosives include about 5 weight percent to about 35 weight percent end-modified PGN and optionally other binders, about 0 to about 65 weight percent oxidizer, about 0 to about 90 weight percent explosive filler, about 0 to about 40 weight percent metal, and about 0 to about 25 weight percent plasticizer.

End-modified PGN may also be used as a binder for composite propellant compositions including minimum smoke, reduced smoke, and smoke propellants.

Minimum smoke propellants generally include as ingredients the following: about 4 weight percent to about 30 weight percent binder, about 0.5 weight percent to about 3 weight percent curative, about 0.25 weight percent to about 2 weight percent cure catalyst, about 0 to about 80 weight percent solid oxidizer, about 0 to about 50 weight percent energetic solid filler, and about 0 to about 30 weight percent plasticizer. Other additives, such as about 0 to about 5 weight percent ballistic modifiers, may also be added.

Conventional formulations for reduced smoke propellants generally are similar to minimum smoke propellants. However, if ammonium perchlorate is selected as a component of the oxidizer and/or aluminum or aluminum oxide is selected as a component of the fuel, the ammonium perchlorate, aluminum, and aluminum oxide are used in sufficiently low amounts to retain the desired reduced smoke properties. Generally, aluminum is present in an amount of not more than about 3 weight percent for reduced smoke propellants.

Conventional formulations for the smoke propellants generally are similar to those of reduced smoke propellants but do not contain undue restrictions on the smoke generating components. Thus, aluminum can be used in concentrations as high as about 22 weight percent (or as limited by combustion efficiency) and the ammonium perchlorate can be used in concentrations as high as about 80 weight percent (or as limited by theoretical performance) in smoke propellants.

Methods of preparing energetic compositions are generally known in the art and are set forth in A. Davenas, Solid Rocket Propulsion Technology (1993) and R. Meyer et al., Explosives (4th ed. 1993).

End-modified PGN may be used alone or in combination with other energetic and inert binders, or combinations thereof. Representative inert polymeric binders that may be used in combination with end-modified PGN include hydroxyl-terminated polybutadiene (HTPB), polybutadiene-acrylonitrile-acrylic acid terpolymer (PBAN), poly(propylene glycol) (PPG), poly(ethylene glycol) (PEG), polyesters, polyacrylates, polymethacrylates, cellulose acetate butyrate (CAB), and combinations and copolymers thereof. Representative energetic polymeric binders that may be used in combination with end-modified PGN include poly(nitrato methyl methyl oxetane) (polyNMMO), poly(glycidyl azide) (PGA), nitrocellulose (NC), diethyleneglycol-triethyleneglycol-nitraminodiacetic acid terpolymer, poly(bisazidomethyl oxetane) (polyBAMO), poly(azido methyl methyl oxetane) (polyAMMO), poly(nitramino methyl methyl oxetane) (polyNAMMO), copolyBAMO/NMMO, polyBAMO/AMMO, and combinations and copolymers thereof. The binder can optionally be halogenated, such as fluorinated ethylene propylene copolymer, chlorotrifluoroethylene and vinylidene fluoride copolymer, polyvinylidene fluoride, polydifluorochloroethylene, fluorinated polyethers, poly(vinyl chloride) (PVC), polytetrafluoroethylene, and combinations thereof.

Representative oxidizers include ammonium perchlorate (AP), ammonium nitrate (AN), hydroxylammonium nitrate (HAN), ammonium dinitramide (ADN), hydrazinium nitroformate (HNF), and mixtures thereof The oxidizer may be present as a powder, particles, and/or in other forms.

Representative reactive metals include aluminum, magnesium, boron, titanium, zirconium, and mixtures thereof These metals may be present as a powder, particles, and/or in other forms.

Energetic fuels (for propellants) or explosive filler (for explosives and pyrotechnics) that may be used in combination with end-modified PGN include the following: nitramines such as 4,10-dinitro-2,6,8,12-tetraoxa-4-10-diazatetracyclo-[5.5.0.0$^{5,9}$.0$^{3,11}$]-dodecane (TEX), 1,3,5-trinitro-1,3,5-triaza-cyclohexane (RDX), 1,3,5,7-tetranitro-1,3,5,7-tetraazacyclooctane (HMX), and 2,4,6,8,10,12-hexanitro-2,4,6,8,10,12-hexaazatetracyclo[5.5.0.0$^{5,9}$.0$^{3,11}$]-dodecane (CL-20 or HNIW); 3-nitro-1,2,4-triazol-5-one (NTO);

nitroguanidine (NQ), 1,3,5-triamino-2,4,6-trinitrobenzene (TATB), and 1,1-diamino-2,2-dinitroethane (DADNE).

End-modified PGN may also be used to prepare high solids (more than about 90% solid ingredients) as pressable or extrudable explosives. The pressable or extrudable explosives can also contain one or more inert plasticizers and/or one or more energetic plasticizers. Representative inert plasticizers include dioctyladipate (DOA), isodecylperlargonate (IDP), dioctylphthalate (DOP), dioctylmaleate (DOM), dibutylphthalate (DBP), oleyl nitrile, or combinations thereof. Representative energetic plasticizers include bis(2,2-dinitropropyl)acetal/bis(2,2-dinitropropyl)formal(BDNPF/A), diglycerol tetranitrate (DGTN), trimethylolethanetrinitrate (TMETN), triethyleneglycoldinitrate (TEGDN), diethyleneglycoldinitrate (DEGDN), nitroglycerin (NG), butanetrioltrinitrate (BTTN), alkyl NENAs (nitratoethylnitramine), and combinations thereof.

A list of representative ballistic modifiers include, by way of example, Lewis acids, iron oxide ($Fe_2O_3$), bismuth-containing compounds, lead and lead-containing compounds, such as lead salts and organometallic lead compounds.

The following examples are offered to further illustrate embodiments of the synthesis methods of the present invention. These examples are nonlimiting and, therefore, not exhaustive of the scope of this invention.

EXAMPLES

Example 1

Epoxidation of PGN

In a one-liter, three-neck, round-bottomed flask equipped with a magnetic stirrer, thermometer and additional funnel, was placed 50 grams of PGN. The PGN was then dissolved in 250 ml of THF. To the PGN solution was added 4.0 grams of KOH dissolved in 4.0 ml of distilled water over the course of approximately 15 seconds. The reaction was stirred at room temperature for 18 hours.

Example 2

Monitoring of Epoxide Ring-Forming Reaction Via $^{13}C$ NMR

The completeness of the epoxide ring-forming reaction was monitored via $^{13}C$ NMR. Briefly, a small aliquot of the reaction constituents was obtained and the solvent removed using a rotovap. The NMR sample was then prepared in deuterated dichloromethane using standard techniques known in the art. $^{13}C$ NMR was preformed on the sample using a Joel NMR and standard techniques known in the art. If the reaction was completed to the extent required, the reaction was stopped. If the reaction has not proceeded to the extent required, additional time may be allowed for the reaction to proceed to a further extent. In the alternative, additional KOH may be added to the reaction to allow to proceed to a further extent.

Example 3

Washing of End-product of the Epoxide Ring-forming Reaction

The reaction production was washed twice for 15 minutes with 400 ml brine. During the washing steps, the reaction solution was mildly stirred. After each wash the solution was allowed to separate until organic and non-organic layers formed. After the layers separated, the aqueous layer was removed.

To ensure the completeness of a washing step, the reaction product of the epoxide ring-forming reaction was monitored by examining an aliquot of the reaction product after separation for the presence of nitrate. The nitrate level was examined by ion chromatography using standard equipment and techniques in the art. If the nitrate level in the reaction product is greater than 0.01%, additional washing steps were undertaken.

Example 4

Drying of Washed End-product of Epoxide Ring-Forming Reaction

The washed end-product of epoxide ring-forming reaction was dried of water by placing the solution over $MgSO_4$ for 30 minutes. After drying was complete, the $MgSO_4$ was removed from the solution via filtering using a grade #1 or a grade #4 Whatman paper filter and a Büchner funnel.

Example 5

Epoxide Ring-Opening Reaction to Form Modified PGN

The epoxide ring-opening reaction was carried out in the same reaction vessel used for epoxide ring formation. Before the washed and dried epoxide ring-containing solution was reintroduced into the reaction vessel, the reaction vessel was washed with water and then with THF to remove any remaining solids in the reactor. To the reaction vessel containing the epoxide ring-containing solution a solution of 5 ml of $H_2SO_4$ dissolved in 50 ml of distilled water was added quickly using the addition funnel. The reaction solution was then heated to 125° F. and stirred at reflux for 3.5 hours.

Example 6

Monitoring of Epoxide Ring-Opening Reaction Via $^{1}H$ NMR

The completeness of the epoxide ring-opening reaction was monitored via $^{1}H$ NMR. Briefly, a small aliquot of the reaction constituents was obtained and the solvent removed using a rotovap. The NMR sample was then prepared in deuterated acetone using standard techniques known in the art. $^{1}H$ NMR was performed on the sample using a Joel NMR and standard techniques known in the art. If the reaction was completed to the extent required, the reaction was stopped. If the reaction has not proceeded to the extent required, additional time may be allowed for the reaction to proceed to a further extent. In the alternative, additional $H_2SO_4$ may be added to the reaction to allow the reaction to proceed to a further extent.

Example 7

Cooling and Separation of Modified PGN

Once the reaction was completed to the desired extent, stirring was ceased and the modified PGN-containing solution was cooled to room temperature. The modified PGN solution was allowed to separate and the water layer (acidic water layer) was removed from the reactor.

Example 8

Neutralization and pH Adjustment of Modified PGN-Containing Solution

After the completion of the epoxide ring-opening reaction, 300 ml of a 50% aqueous $K_2CO_3$ solution was added to the modified PGN-containing solution and stirred. After 15 minutes, stirring was ceased and the mixture allowed to separate. Once the mixture was separated, the water layer (bottom layer) was removed. After the removal of the water layer, the pH was tested using pH indicator strips.

If the pH was above 7, the pH was further adjusted through repeated washing with a brine solution. Specifically, the end-modified PGN-containing solution was washed twice with brine in a manner similar to the washing carried out in Example 3. Washing may be repeated as necessary until the non-aqueous layer achieves a pH of about 7. After a final separation and removal of the aqueous layer, the end-modified PGN-containing solution was dried using $MgSO_4$ in a manner similar to that described in Example 4.

Example 9

Removal of Solvent and Redissolution in Dichloromethane

The solvent was removed from pH adjusted modified PGN solution through the use of a rotovap set to a temperature of less than about 122° F. Dichloromethane was then added to the reactor followed by an equal volume of water and this mixture was then stirred for 10 minutes. After stirring, the layers were allowed to separate and the aqueous layer removed. The dichloromethane solution of modified PGN was then dried using substantially the same procedure as described in Example 4. If desired, the dichloromethane can be removed using a rotovap as described above. The remaining viscous yellow product may then be collected.

Figure 2:
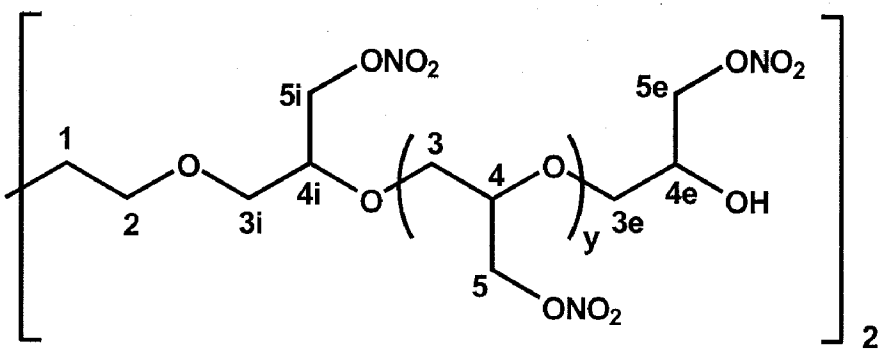
FIG. 2 depicts a chemical structure of PGN wherein individual carbon atoms are numerically indexed to correspond with labeled peaks present in the NMR spectra of FIGS. 3-6.
Figure 3:
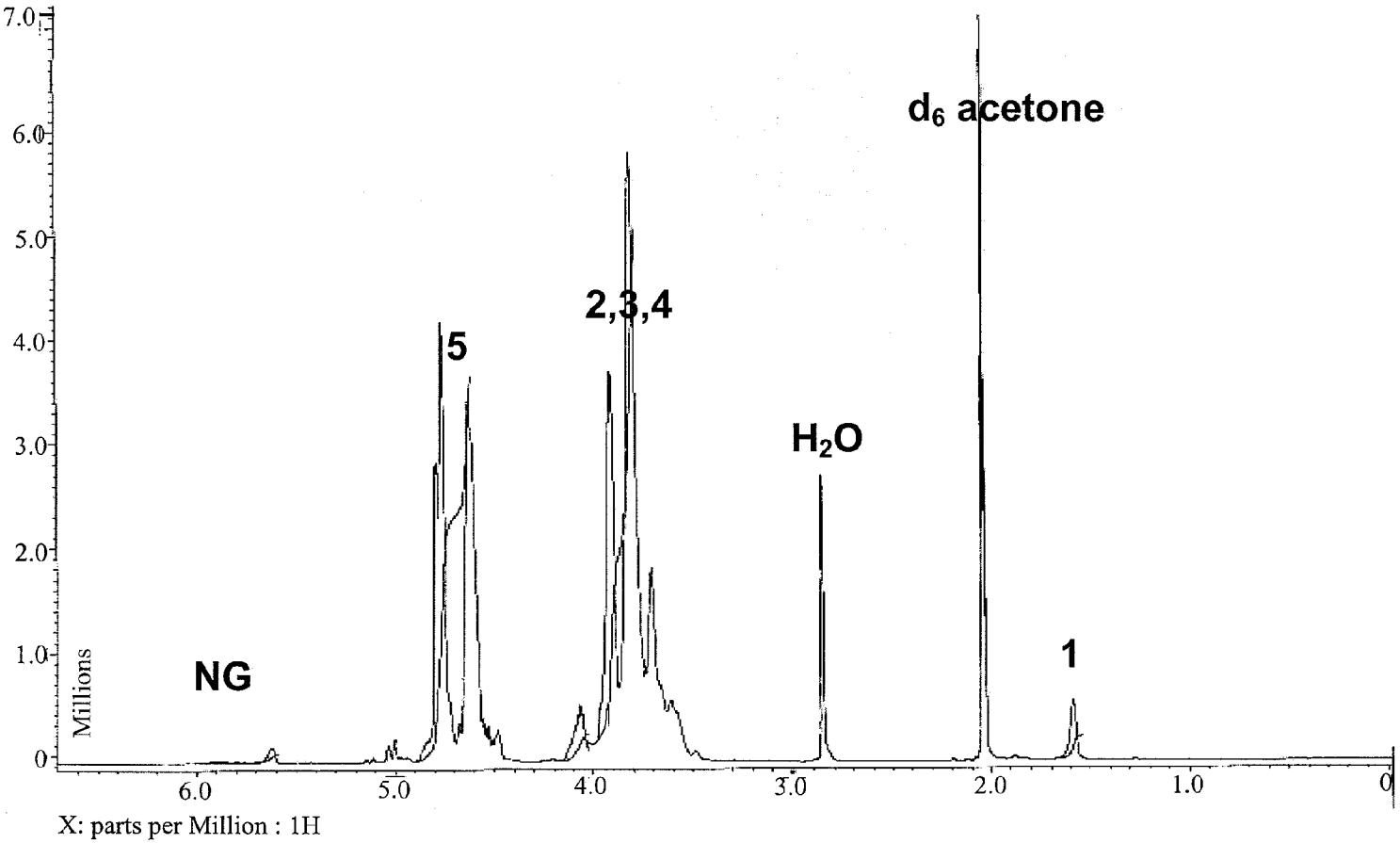
FIG. 3 depicts a $^{1}H$ Nuclear Magnetic Resonance (NMR) spectral assay of unmodified PGN.
Figure 4:
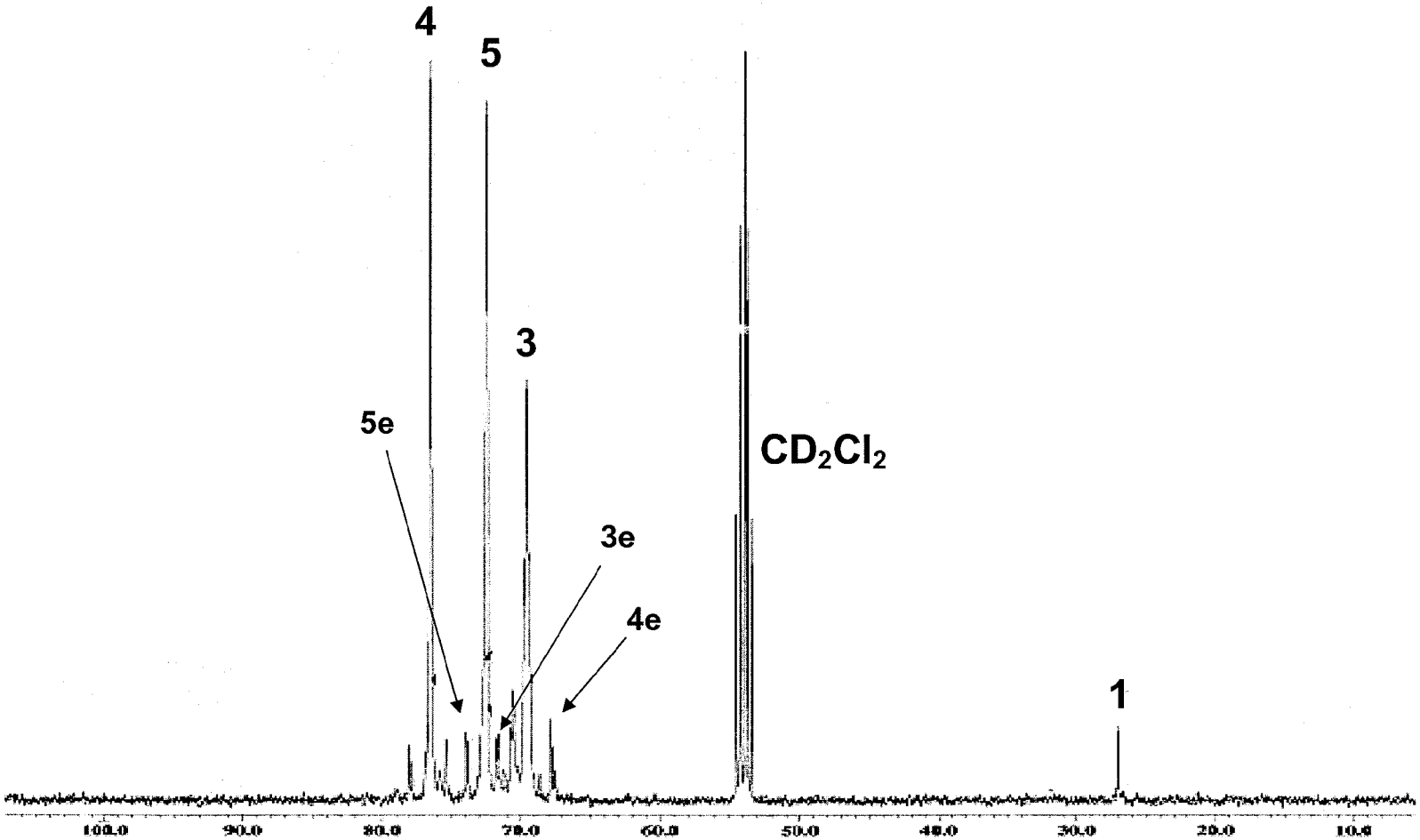
FIG. 4 depicts a $^{13}C$ NMR spectral assay of unmodified PGN.
Figure 5:
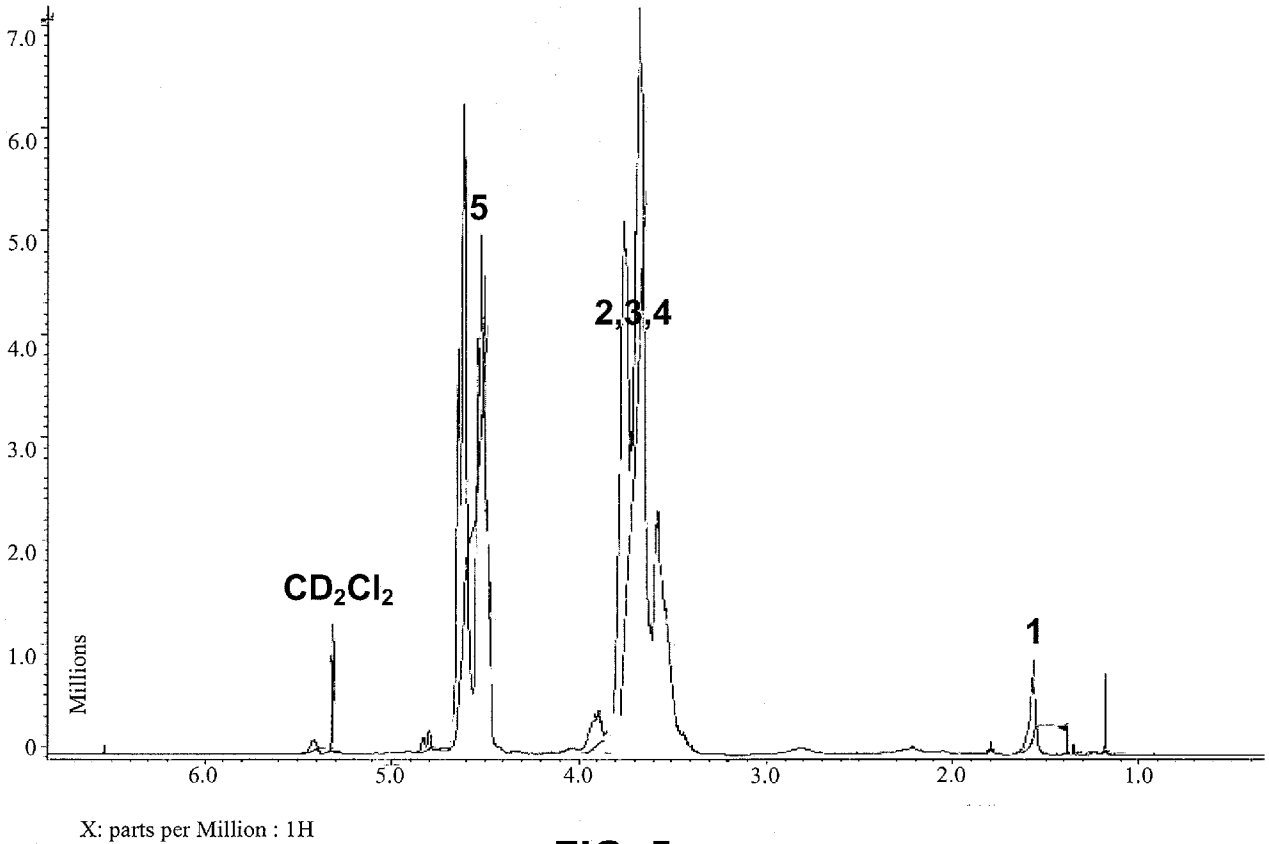
FIG. 5 depicts a $^{1}H$ NMR spectral assay of a PGN modified according to the process of the present invention.
Figure 6:
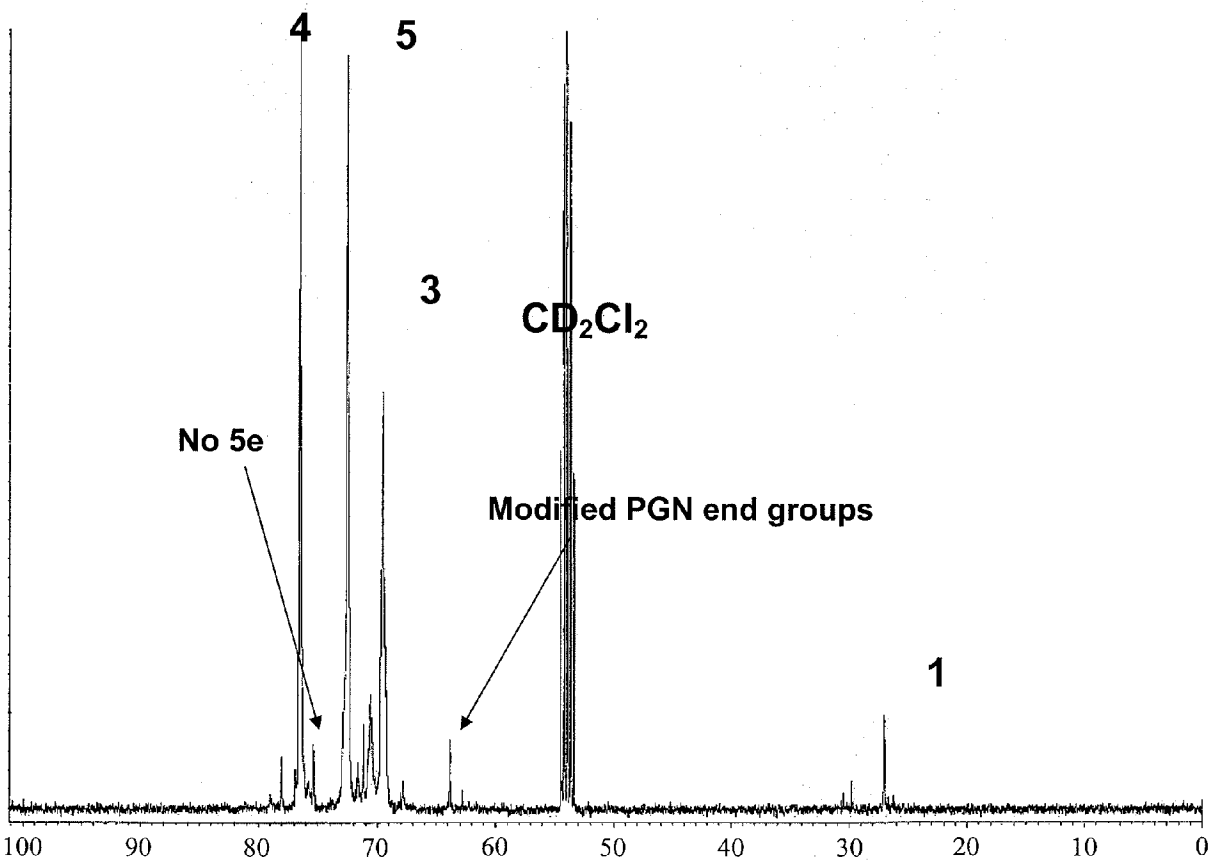
FIG. 6 depicts a $^{13}C$ NMR spectral assay of a PGN modified according to the process of the present invention.

NMR spectra from unmodified and end-modified PGN produced according to the process outline in Examples 1 through 9 are presented in FIGS. 3 through 6. The peaks in the NMR spectra are labeled to corresponding carbon centers as shown in FIG. 2. More specifically, FIG. 3 is a $^1$H NMR of unmodified PGN; FIG. 4 is a $^{13}$C NMR of unmodified PGN; FIG. 5 is a $^1$H NMR of a PGN modified according to the process of the present invention; and FIG. 6 is a $^{13}$C NMR of a PGN modified according to the process of the present invention. As is clearly noted in FIG. 6, the modified PGN no longer contains the groups corresponding to peak 5*e* and has a new group at approximately 6.5 that corresponds to the modified PGN end groups.

Example 9

Shore A Hardness of Propellants Made Using End-modified PGN

One hundred grams of various propellant mixtures containing PGN were cast into slugs in 1.5 inch diameter vials and cured with dibutyltin dilaurate. The propellant mixtures contained PGNs as follows: 2150-44B (PGN comprising ~40% end-modified PGN as determined by $^{13}$C NMR); 2150-56 (PGN comprising ~50% end-modified PGN as determined by $^{13}$C NMR); 2150-55 made by two step process with dichloromethane as solvent for epoxidation reation(PGN comprising>95% end-modified PGN as determined by $^{13}$C NMR); 2150-57 made by two step process with THE as solvent for epoxidation reaction (PGN comprising>95% end-modified PGN as determined by $^{13}$C NMR); 2150-43B (made with end-modified PGN available from ICI).

Figure 7:
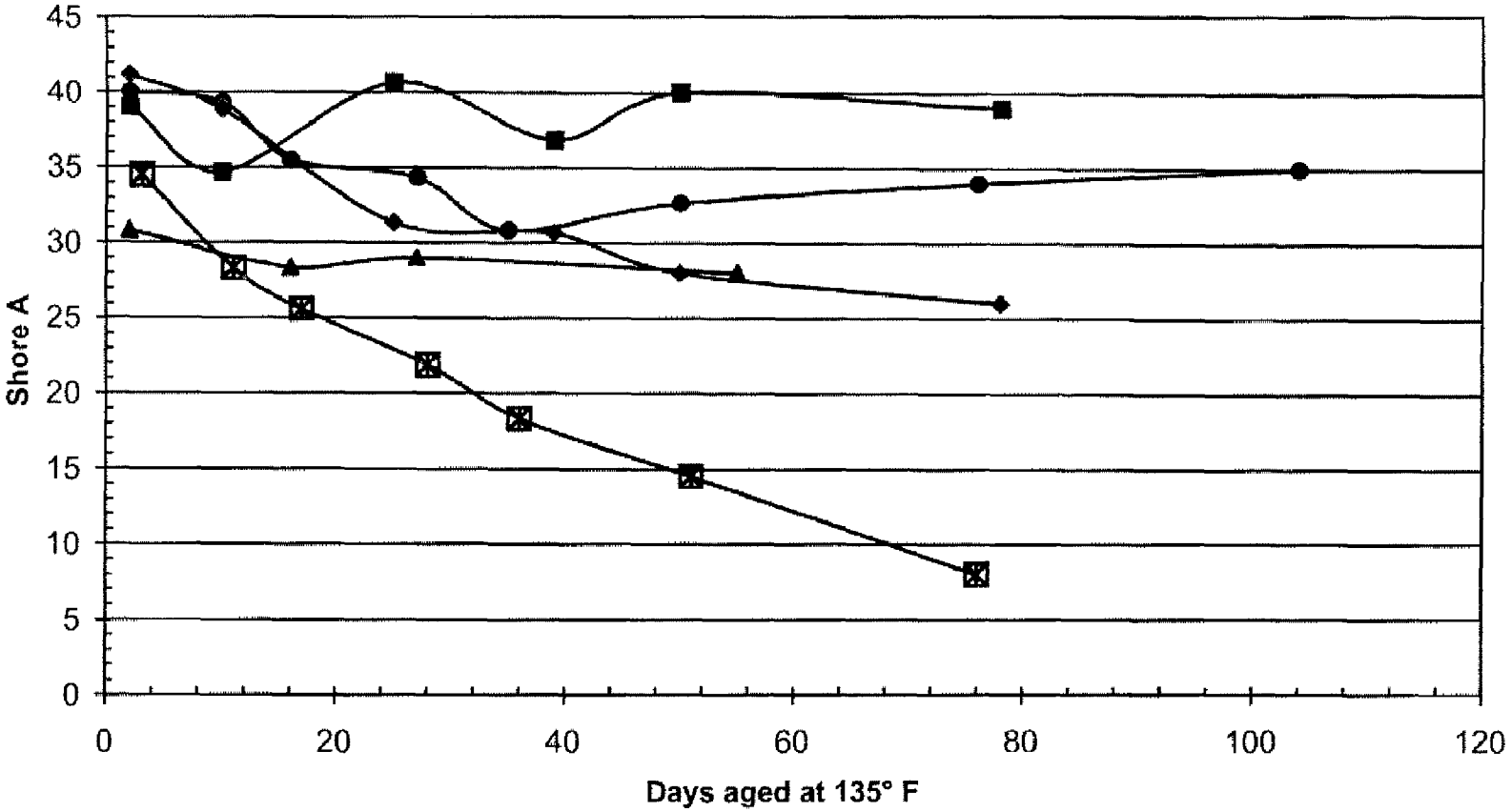
FIG. 7 is a graphical representation of Shore A hardness of various PGN compositions as further identified in the detailed description at various times after catalyst addition; wherein stars represent composition 2150-44B, circles represent composition 2150-43B, squares represent composition 2150-55, diamonds represent composition 2150-66, and triangles represent composition 2150-57.

After casting, each slug was removed and the top sliced off. Shore A was measured on the top at various time intervals after catalyst addition and a new slice removed before each Shore A reading. The Shore A hardness was measured with a standard Shore A gauge manufactured by Zwick & Co. The results of the Shore A testing are presented in FIG. 7, where 2150-44B is represented as stars, 2150-56 as diamonds, 2150-55 as squares, 2150-57 as triangles, and 2150-43B as circles.

All references, including publications, patents, and patent applications, cited herein are hereby incorporated by reference to the same extent as if each reference were individually and specifically indicated to be incorporated by reference and were set forth in its entirety herein.

The references discussed herein are provided solely for their disclosure prior to the filing date of the present application. Nothing herein is to be construed as an admission that the inventors are not entitled to antedate such disclosure by virtue of prior invention.

While this invention has been described in terms of, and with reference to, certain embodiments, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of end-modifying poly(glycidyl nitrate), the method comprising:

end-modifying poly(glycidyl nitrate) in a single solvent to create the following chemical structure:

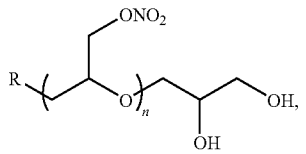

wherein R is a substituent and n is an integer larger than 1.

2. The method according to claim 1, wherein end-modifying poly(glycidyl nitrate) in a single solvent comprises end-modifying the poly(glycidyl nitrate) in tetrahydrafuran.

3. The method according to claim 1, wherein end-modifying poly(glycidyl nitrate) in a single solvent comprises epoxidating the poly(glycidyl nitrate).

4. The method according to claim 3, wherein epoxidating the poly(glycidyl nitrate) comprises reacting the poly(glycidyl nitrate) with a base.

5. The method according to claim 4, further comprising selecting the base from the group consisting of KOH, NaOH, potassium t-butoxide, lithium diisopropyl amide, and potassium 2-methyl-2-butoxide.

6. The method according to claim 3, further comprising washing a reaction product of epoxidating poly(glycidyl nitrate).

7. The method according to claim 6, further comprising washing a reaction product of epoxidating PGN in a solution of sodium chloride or sulfuric acid.

8. The method according to claim 3, further comprising washing a reaction product of epoxidating poly(glycidyl nitrate) until the level of the nitrate product formed from epoxidating the poly(glycidyl nitrate) is less than 1%.

9. The method according to claim 1, further comprising adjusting the pH of the end-modified poly(glycidyl nitrate) to about or below 7.

10. A method for producing an energetic composition, the method comprising:

end-modifying PGN according to the method of claim 1; and preparing an energetic formulation comprising the end-modified poly(glycidyl nitrate).

11. The method according to claim 10, further comprising cross-linking the energetic formulation comprising the end-modified poly(glycidyl nitrate).

12. The method according to claim 10, further comprising cross-linking the energetic formulation comprising the end-modified poly(glycidyl nitrate) with an aliphatic polyisocyanate.

13. The method according to claim 10, further comprising selecting the single solvent to be tetrahydrafuran.

14. The method according to claim 10, further comprising epoxidating poly(glycidyl nitrate).

15. The method according to claim 10, further comprising epoxidating poly(glycidyl nitrate) in the presence of a base.

16. The method according to claim 15, further comprising selecting the base from the group consisting of KOH, NaOH, potassium t-butoxide, lithium diisopropyl amide, and potassium 2-methyl-2-butoxide.

17. The method according to claim 14, further comprising washing a reaction product of epoxidating poly(glycidyl nitrate).

18. The method according to claim 17, further comprising washing a reaction product of epoxidating poly(glycidyl nitrate) in solution of sodium chloride or $H_2SO_4$.

19. The method according to claim 14, further comprising washing a reaction product of epoxidating poly(glycidyl nitrate) until the level of the nitrate product formed from epoxidating the poly(glycidyl nitrate) is less than 1%.

20. The method according to claim 10, further comprising adjusting the pH to about or below 7.

* * * * *

UNITED STATES PATENT AND TRADEMARK OFFICE

CERTIFICATE OF CORRECTION

PATENT NO. : 7,714,078 B2
APPLICATION NO. : 11/553752
DATED : May 11, 2010
INVENTOR(S) : Alexander J. Paraskos, Michael A. Dewey and Wayne Edwards It is certified that error appears in the above-identified patent and that said Letters Patent is hereby corrected as shown below:

On the title page:

In ITEM (73) Assignee: change "Edina, MN" to --Minneapolis, MN--

In ITEM (56) References Cited:

OTHER PUBLICATIONS

Page 1, 2nd column, 3rd line of the 3rd entry (line 15 from top of column), change "Hidrolysis,"" to --Hydrolysis,"--

| | | |
|---|---|---|
| COLUMN 2, | LINE 32, | change "discreet" to --discrete-- |
| COLUMN 4, | LINE 19, | change "out a" to --out at a-- |
| COLUMN 4, | LINES 28-29, | change "sub-jected" to --sub-jecting-- |
| COLUMN 5, | LINE 66, | change "water and then with to remove" to --water to remove-- |
| COLUMN 6, | LINE 23, | change "out a temperature" to --out at a temperature-- |
| COLUMN 6, | LINE 51, | change "In example" to --In an example-- |
| COLUMN 6, | LINE 57, | change "the reactor" to --the reactor.-- |
| COLUMN 7, | LINE 36, | change "art, hut" to --art, but-- |
| COLUMN 8, | LINE 53, | change "triethyoxonium" to --triethyloxonium-- |
| COLUMN 11, | LINE 52, | change "Joel NMR" to --Jeol NMR-- |
| COLUMN 12, | LINE 50, | change "Joel NMR" to --Jeol NMR-- |
| COLUMN 13, | LINE 65, | change "reation(PGN" to --reaction (PGN-- |

Signed and Sealed this
Thirteenth Day of September, 2011

David J. Kappos

David J. Kappos
*Director of the United States Patent and Trademark Office*